US008862472B2

(12) United States Patent
Wilfart et al.

(10) Patent No.: US 8,862,472 B2
(45) Date of Patent: Oct. 14, 2014

(54) SPEECH SYNTHESIS AND CODING METHODS

(75) Inventors: Geoffrey Wilfart, Saint-Saulve (FR); Thomas Drugman, Strepy Braquegnies (BE); Thierry Dutoit, Sirault (BE)

(73) Assignees: Universite de Mons, Mons (BE); Acapela Group S.A., Mons (BE)

( * ) Notice: Subject to any disclaimer, the term of this patent is extended or adjusted under 35 U.S.C. 154(b) by 410 days.

(21) Appl. No.: 13/264,571

(22) PCT Filed: Mar. 30, 2010

(86) PCT No.: PCT/EP2010/054244

§ 371 (c)(1),
(2), (4) Date: Jan. 31, 2012

(87) PCT Pub. No.: WO2010/118953

PCT Pub. Date: Oct. 21, 2010

(65) Prior Publication Data

US 2012/0123782 A1 May 17, 2012

(30) Foreign Application Priority Data

Apr. 16, 2009 (EP) ..... 09158056

(51) Int. Cl.

| | |
|---|---|
| ***G10L 13/00*** | (2006.01) |
| ***G10L 19/125*** | (2013.01) |
| ***G10L 13/04*** | (2013.01) |
| ***G10L 13/06*** | (2013.01) |

(52) U.S. Cl.

CPC ..... *G10L 19/125* (2013.01); *G10L 13/04* (2013.01); *G10L 13/06* (2013.01)

USPC ..... 704/261

(58) Field of Classification Search

CPC ..... G10L 19/125; G10L 19/08; G10L 25/90; G10L 25/78; G10L 25/93

USPC ..... 704/261, 264, 208, 219, 220, 207

See application file for complete search history.

(56) References Cited

U.S. PATENT DOCUMENTS 6,202,048 B1 3/2001 Tsuchiya
6,304,846 B1 * 10/2001 George et al. ..... 704/270

(Continued)

FOREIGN PATENT DOCUMENTS

EP 0703565 A2 3/1996

OTHER PUBLICATIONS

Iain Mann, An Investigation of non-linear speech synthesis and pitch modification techniques, Jun. 2000, University of Edinburgh.*

(Continued)

*Primary Examiner* — Jakieda Jackson

(74) *Attorney, Agent, or Firm* — The Marbury Law Group, PLLC

(57) ABSTRACT

The present invention is related to a method for coding excitation signal of a target speech comprising the steps of: extracting from a set of training normalized residual frames, a set of relevant normalized residual frames, said training residual frames being extracted from a training speech, synchronized on Glottal Closure Instant(GCI), pitch and energy normalized; determining the target excitation signal of the target speech; dividing said target excitation signal into GCI synchronized target frames; determining the local pitch and energy of the GCI synchronized target frames; normalizing the GCI synchronized target frames in both energy and pitch, to obtain target normalized residual frames; determining coefficients of linear combination of said extracted set of relevant normalized residual frames to build synthetic normalized residual frames close to each target normalized residual frames; wherein the coding parameters for each target residual frames comprise the determined coefficients.

15 Claims, 8 Drawing Sheets

(56) References Cited

U.S. PATENT DOCUMENTS

| | | | | |
|---|---|---|---|---|
| 6,470,308 | B1 | 10/2002 | Ma | |
| 7,842,874 | B2 * | 11/2010 | Jehan | 84/609 |
| 2002/0143526 | A1 * | 10/2002 | Coorman et al. | 704/211 |
| 2003/0050786 | A1 * | 3/2003 | Jax et al. | 704/500 |
| 2009/0306988 | A1 * | 12/2009 | Chen et al. | 704/261 |

OTHER PUBLICATIONS

B. Yegnanarayana, Extraction of Vocal-Tract System Characteristics from Speech Signals, Jul. 1998, IEEE, pp. 313-327.*

Nelson et al., Vocal tract filtering and sound radiation in a songbird, Nov. 2004, The Company of Biologist, pp. 297-308.*

International Search Report and Written Opinion issued in PCT Application No. PCT/EP2010/054244, mailed on Jul. 13, 2010.

International Preliminary Report on Patentability issued in PCT Application No. PCT/EP2010/054244, mailed on Oct. 27, 2011.

Drugman, Thomas, et al., "Using a pitch-synchronous residual codebook for hybrid HMM/frame selection speech synthesis," Acoustics, Speech and Signal Processing, Apr. 19, 2009, pp. 3793-3796.

Latsch, Vagner, L., et al., "On the construction of unit databanks for text-to-speech systems," Telecommunications Symposium, Sep. 1, 2006, pp. 340-343.

Miki, Satoshi, et al., "Pitch Synchronous Innovation Code Excited Linear Prediction (PSI-CELP)," Electronics and Communications in Japan, Part III: Fundamental Electronic Science, vol. 77, Issue 12, Dec. 1, 1994, pp. 36-49.

Black, A. W., et al., "Statistical Parametric Speech Synthesis," ICASSP, pp. 1229-1232, 2007.

Cabral, J.P., et al., "Pitch-Synchronous Time-Scaling for High-Frequency Excitation Regeneration," Interspeech, Proc. Interspeech 2005, Lisbon, Portugal, Sep. 2005, pp. 1137-1140.

Maia, R., et al., "An Excitation Model for HMM-Based Speech Synthesis Based on Residual Modeling," ISCA SSW6, 2007.

Tian, W.S., et al., "Pitch Synchronous Extended Excitation in Multimode CELP," IEEE Communications Letters, vol. 3, No. 9, Sep. 1999, pp. 275-276.

Tokuda, K., et al., "An HMM-Based Speech Synthesis System Applied to English," in Proc. of IEEE Workshop in Speech Synthesis, 2002.

Yoshimura, T., et al., "Mixed Excitation for HMM-Based Speech Synthesis," in Proc. of Eurospeech, 2001.

* cited by examiner

SPEECH SYNTHESIS AND CODING METHODS

FIELD OF THE INVENTION

The present invention is related to speech coding and synthesis methods.

STATE OF THE ART

Statistical parametric speech synthesisers have recently shown their ability to produce natural-sounding and flexible voices. Unfortunately the delivered quality suffers from a typical buzziness due to the fact that speech is vocoded.

For the last decade, Unit Selection-based methods have clearly emerged in speech synthesis. These techniques rely on a huge corpus (typically several hundreds of MB) covering as much as possible the diversity one can find in the speech signal. During synthesis, speech is obtained by concatenating natural units picked up from the corpus. As the database contains several examples for each speech unit, the problem consists in finding the best path through a lattice of potential candidates by minimising selection and concatenation costs.

This approach generally generates speech with high naturalness and intelligibility. However quality may degrade severely when an under-represented unit is required or when a bad jointure (between two selected units) causes a discontinuity.

More recently, K. Tokuda et al., in "An HMM-based speech synthesis system applied to English," Proc. IEEE Workshop on Speech Synthesis, 2002, p. 227-230, propose a new synthesis method: the Statistical Parametric Speech Synthesis. This approach relies on a statistical modelling of speech parameters. After a training step, it is expected that this modelling has the ability to generate realistic sequences of such parameters. The most famous technique derived from this framework is certainly the HMM-based speech synthesis, which obtained in recent subjective tests a performance comparable to Unit Selection-based systems. An important advantage of such a technique is its flexibility for controlling speech variations (such as emotions or expressiveness) and for easily creating new voices (via statistical voice conversion). Its two main drawbacks, due to its inherent nature, are:

- the lack of naturalness of the generated trajectories, the statistical processing having a tendency to remove details in the feature evolution, and generated trajectories being over-smoothed, which makes the synthetic speech sound muffled;
- the "buzziness" of produced speech, which suffers from a typical vocoder quality.

While the parameters characterising spectrum and prosody are rather well-established, improvement can be expected by adopting a more suited excitation modelling. Indeed the traditional excitation considers either a white noise or a pulse train during unvoiced or voiced segments respectively. Inspired from the physiological process of phonation where the glottal signal is composed of a combination of periodic and aperiodic components, the use of a Mixed Excitation (ME) has been proposed. The ME is generally achieved as in FIG. 1.

T. Yoshimura et al., in "Mixed-excitation for HMM-based speech synthesis", Proc. Eurospeech01, 2001, pp. 2259-2262, propose to derive the filter coefficients from bandpass voicing strengths.

In "An excitation model for HMM-based speech synthesis based on residual modeling," Proc. ISCA SSW6, 2007, R. Maia et al., state-dependent high-degree filters are directly trained using a closed loop procedure.

Aims of the Invention

The present invention aims at providing excitation signals for speech synthesis that overcome the drawbacks of prior art.

More specifically, the present invention aims at providing an excitation signal for voiced sequences that reduces the "buzziness" or "metallic-like" character of synthesised speech.

SUMMARY OF THE INVENTION

The present invention is related to a method for coding excitation signal of a target speech comprising the steps of:

- extracting from a set of training normalised residual frames, a set of relevant normalised residual frames, said training residual frames being extracted from a training speech, synchronised on Glottal Closure Instant (GCI) and pitch and energy normalised;
- determining the target excitation signal of the target speech;
- dividing said target excitation signal into GCI synchronised target frames;
- determining the local pitch and energy of the GCI synchronised target frames;
- normalising the GCI synchronised target frames in both energy and pitch, to obtain target normalised residual frames;
- determining coefficients of linear combination of said extracted set of relevant normalised residual frames to build synthetic normalised residual frames closest to each target normalised residual frames;

wherein the coding parameters for each target residual frames comprise the determined coefficients.

The target excitation signal can be obtained by applying the inverse of a predetermined synthesis filter to the target signal.

Preferably, said synthesis filter is determined by spectral analysis method, preferably linear predictive method, applied on the target speech.

By set of relevant normalised residual frames, it is meant a minimum set of normalised residual frames giving the highest amount of information to build synthetic normalised residual frames, by linear combination of the relevant normalised residual frames, closest to target normalised residual frames.

Preferably, coding parameters further comprises prosodic parameters.

More preferably, said prosodic parameters comprises (consists of) energy and pitch.

Said set of relevant normalised residual frames is preferably determined by statistical method, preferably selected from the group consisting of K-means algorithm and PCA analysis.

Preferably, the set of relevant normalised residual frames is determined by K-means algorithm, the set of relevant normalised residual frames being the determined clusters centroids. In that case, the coefficient associated with the cluster centroid closest to the target normalised residual frame is preferably equal to one, the others being null, or, equivalently, only one parameter is used, representing the number of the closest centroid.

Alternatively, said set of relevant normalised residual frames is a set of first eigenresiduals determined by principal component analysis (PCA). Eigenresiduals is to to be understood here as the eigenvectors resulting from the PCA analysis.

Preferably, said set of first eigenresiduals is selected to allow dimensionality reduction.

Preferably, said relevant set of first eigenresiduals is obtained according to an information rate criterion, where information rate is defined as:

$$I(k) = \frac{\sum_{i=1}^{k} \lambda_i}{\sum_{i=1}^{m} \lambda_i}$$

where $\lambda_i$ means the i-th eigenvalue determined by PCA, in decreasing order, and n is the total number of eigenvalues.

The set of training normalised residual frames is preferably determined by a method comprising the steps of:

- providing a record of the training speech;
- dividing said speech sample into sub-frames having a predetermined duration;
- analysing said training sub-frames to determine synthesis filters;
- applying the inverse synthesis filters to said training sub-frames to determine training residual signals;
- determining glottal closure instants (GCI) of said training residual signals;
- determining a local pitch period and energy of said training residual signals;
- dividing said training residual signals into training residual frames having a duration proportional to the local pitch period, so that said training residual frames are synchronised around determined GCI;
- resampling said training residual frames in constant pitch training residual frames;
- normalising the energy of said constant pitch training residual frames to obtain a set of GCI-synchronised, pitch and energy-normalised residual frames.

Another aspect of the invention is related to a method for excitation signal synthesis using the coding method according to the present invention, further comprising the steps of:

- building synthetic normalised residual frames by linear combination of said set of relevant normalised residual frames, using the coding parameters;
- denormalising said synthetic normalised residual frames in pitch and energy to obtain synthetic residual frames having the target local pitch period and energy;
- recombining said synthetic residual frames by pitch-synchronous overlap add method to obtain a synthetic excitation signal.

Preferably, said set of relevant normalised residual frames is a set of first eigenresiduals determined by PCA, and a high frequency noise is added to said synthetic residual frames. Said high frequency noise can have a low frequency cut-off comprised between 2 and 6 kHz, preferably between 3 and 5 kHz, most preferably around 4 kHz.

Another aspect of the invention is related to a method for parametric speech synthesis using the method for excitation signal synthesis of the present invention for determining the excitation signal of voiced sequences of synthetic speech signal.

Preferably, the method for parametric speech synthesis further comprises the step of filtering said synthetic excitation signal by the synthesis filters used to extract the target excitation signals.

The present invention is also related to a set of instructions recorded on a non-transitory computer readable medium, which, when executed on a computer, performs the method according to the invention.

DETAILED DESCRIPTION OF THE INVENTION

The present invention discloses a new excitation method for voiced segments to reduce the buzziness of parametric speech synthesisers.

The present invention is also related to a coding method for coding such an excitation.

In a first step, a set of residual frames is extracted from a speech sample (training dataset). This operation is achieved by dividing the speech sample in training sub-frames of predetermined duration, analysing each training sub-frames to define synthesis filters, such as a linear predictive synthesis filters, and, then, applying the corresponding inverse filter to each sub-frames of the speech sample, obtaining a residual signal, divided in residual frames.

Preferably, Mel-Generalised Cepstral coefficients (MGC) are used to define said filter, so as to accurately and robustly capture the spectral envelope of speech signal. The defined coefficients are then used to determine the linear predictive synthesis filter. The inverse of the determined synthesis filter is then used to extract residual frames.

The residual frames are divided so that they are synchronised on Glottal Closure Instants (GCIs). In order to locate GCIs, a method based on the Centre of Gravity (CoG) in energy of the speech signal can be used. Preferably, the determined residual frames are centred on GCIs.

Figure 1:
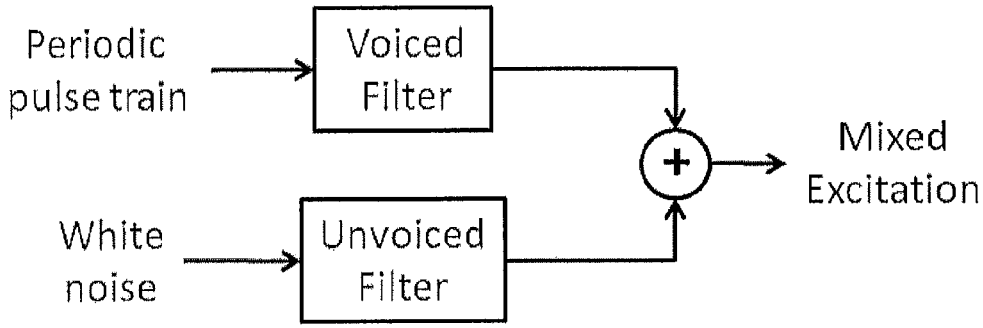
FIG. 1 is representing mixed excitation method.
Figure 2:
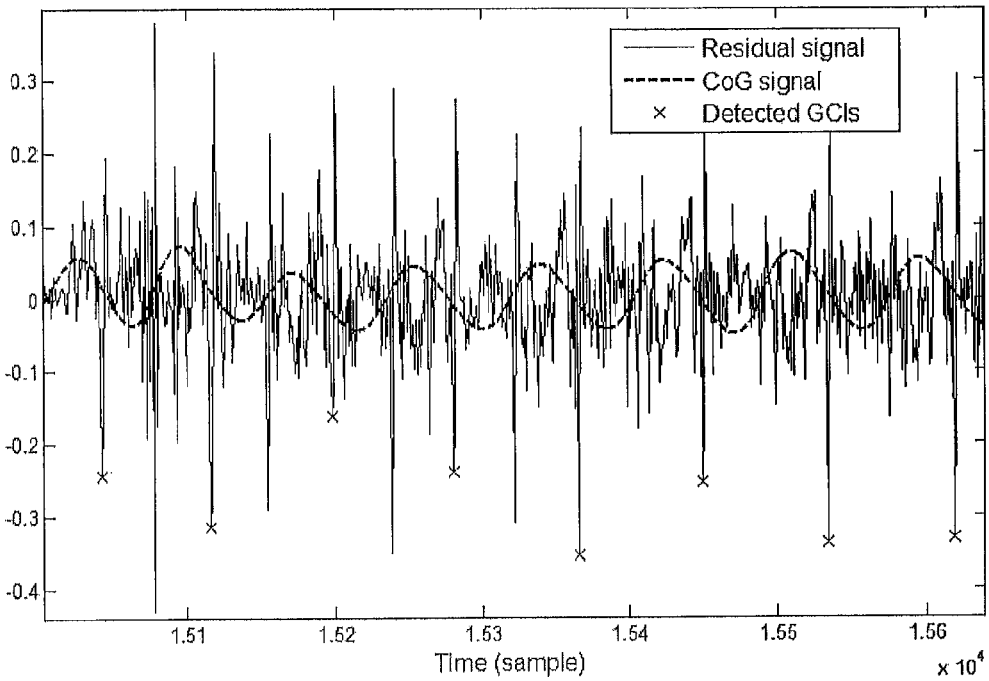
FIG. 2 is representing a method for determining the glottal closure instant using the centre of gravity technique.

FIG. 2 exhibits how a peak-picking technique coupled with the detection of zero-crossings (from positive to negative) of the CoG can further improve the detection of the GCI positions.

Preferably, residual frames are windowed by a two-period Hanning window. To ensure a point of comparison between residual frames before extracting most relevant residual frames, GCI-alignment is not sufficient, normalisation in both pitch and energy is required.

Pitch normalisation can be achieved by resampling, which retains the residual frames' most important features. As a matter of fact, assuming that the residual obtained by inverse filtering approximates the glottal flow first derivative, resampling this signal preserves the open quotient, asymmetry coefficient (and consequently the Fg/F0 ratio, where Fg stands for the glottal format frequency, and F0 stands for the pitch) as well as the return phase characteristics.

At synthesis time, residual frames will be obtained by resampling a combination of relevant pitch and energy normalised residual frames. If these have not a sufficiently low pitch, the ensuing upsampling will compress the spectrum and cause the appearance of "energy holes" at high frequencies. In order to avoid it, the speaker's pitch histogram P(F0) is analysed and the chosen normalised pitch value F0* typically satisfies:

$$\int_{F^*_0}^{\infty} P(F_0)dF_0 \approx 0.8$$

such that only 20% frames will be slightly upsampled at synthesis time.

Figure 3:
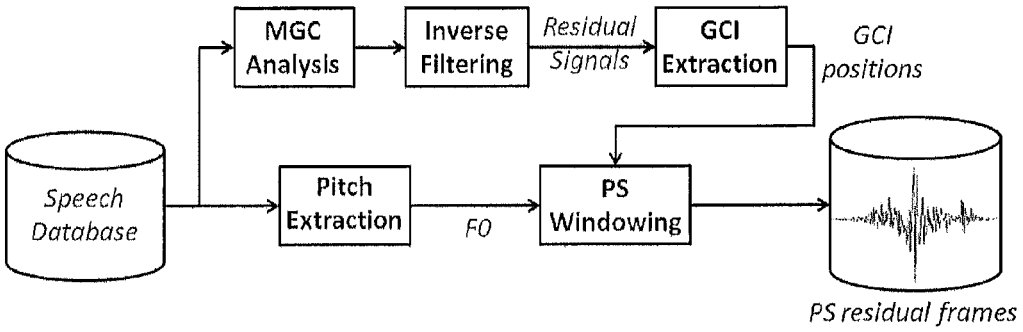
FIG. 3 is representing a method to obtain a dataset of pitch-synchronous residual frames, suitable for statistical analysis.
Figure 4:
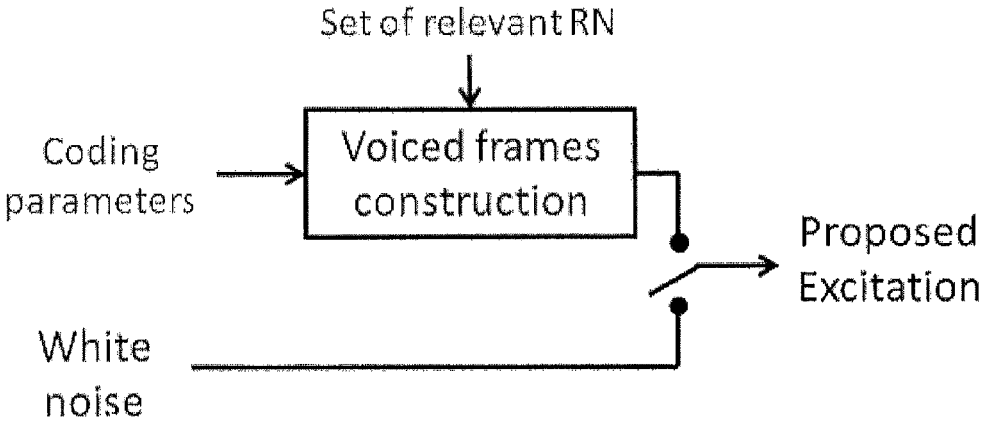
FIG. 4 is representing the excitation method according to the present invention.

The general workflow for extracting pitch-synchronous residual frames is represented in FIG. 3.

At this point, we have thus at our disposal a dataset of GCI-synchronised, pitch and energy-normalised residual frames, called hereafter RN frames, which is suited for applying statistical clustering methods such as principal component analysis (PCA) or K-Means method.

Those methods are then used to define a set of relevant RN frames, which are used to rebuild target residual frames. By set of relevant frames, it is meant a minimum set of frames giving the highest amount of information to rebuild residual frames closest to a target residual frame, or, equivalently, a set of RN frames, allowing the highest dimensionality reduction in the description of target frames, with minimum loss of information.

As a first alternative, determination of the set of relevant frames is based on the decomposition of pitch-synchronous residual frames on an orthonormal basis obtained by Principal Component Analysis (PCA). This basis contains a limited number of RN frames and is computed on a relatively small speech database (about 20 min.), from which a dataset of voiced frames is extracted.

Principal Component Analysis is an orthogonal linear transformation which applies a rotation of the axis system so as to obtain the best representation of the input data, in the Least Squared (LS) sense. It can be shown that the LS criterion is equivalent to maximising the data dispersion along the new axes. PCA can then be achieved by calculating the eigenvalues and eigenvectors of the data covariance matrix.

Figure 5:
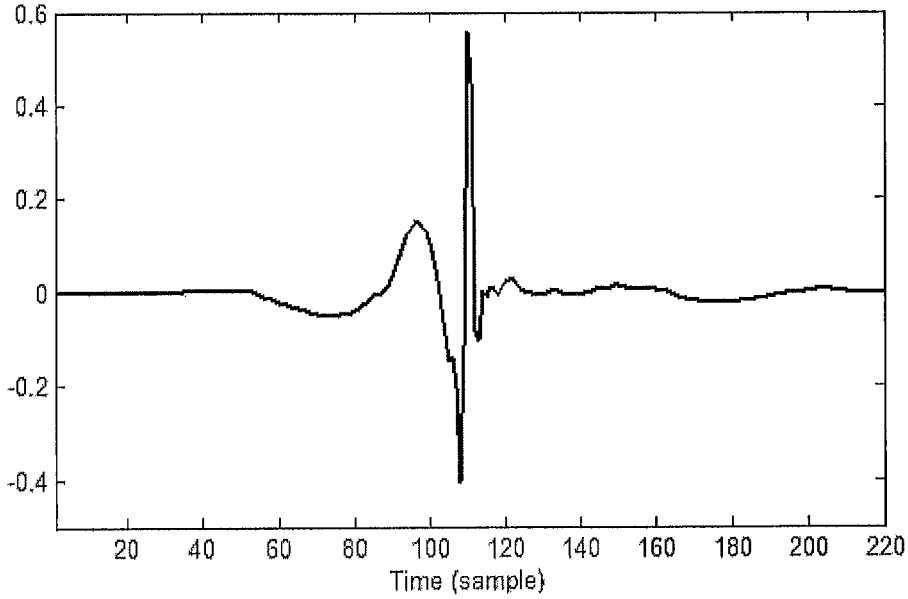
FIG. 5 is representing the first eigenresidual for the female speaker SLT.

For a dataset consisting of N residual frames of m samples. PCA computation will lead to m eigenvalues $\lambda_i$ with their corresponding eigenvectors μi (called hereafter eigenresiduals). For example, the first eigenresidual in the case of a particular female speaker is represented in FIG. 5. $\lambda_i$ represents the data dispersion along axis $\mu_i$ and is consequently a measure of the information this eigenresidual conveys on the dataset. This is important in order to apply dimensionality reduction. Let us define I(k), the information rate when using k first eigenresiduals, as the ratio of the dispersion along these k axes over the total dispersion:

$$I(k) = \frac{\sum_{i=1}^{k} \lambda_i}{\sum_{i=1}^{m} \lambda_i}$$

Figure 6:
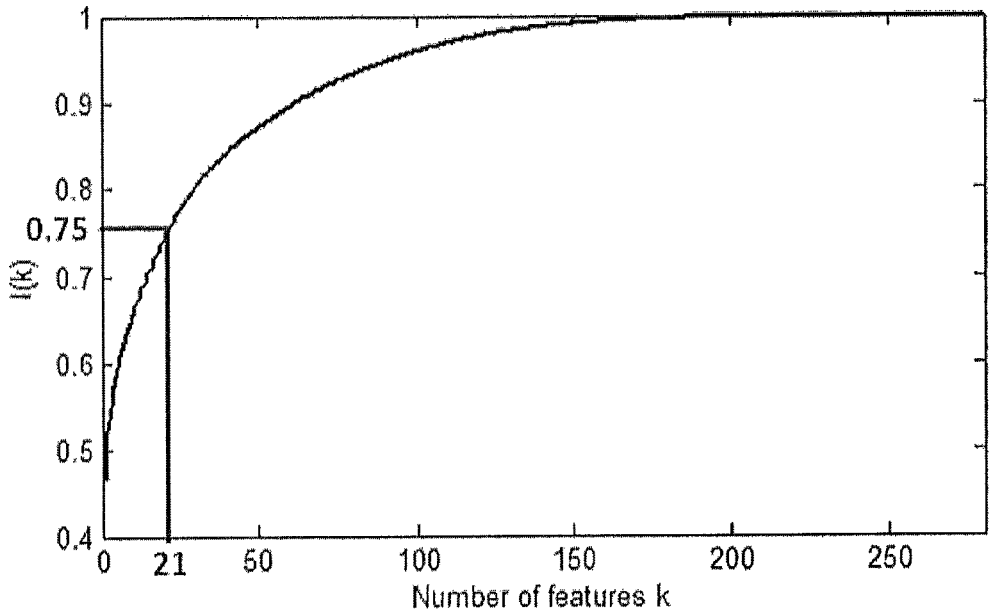
FIG. 6 is representing the "information rate" when using k eigenresiduals for speaker AWB.

FIG. 6 displays this variable for the male speaker AWB (m=280 in this case). Through subjective tests on an Analysis-Synthesis application, we observed that choosing k such that I(k) is greater than about 0.75 has almost inaudible effects when compared to the original file. Back to the example of FIG. 6, this implies that about 20 eigenresiduals can be efficiently used for this speaker. This means that target frames can be efficiently described by a vector having a dimensionality of 20, defined by PCA transformation (projection of the target frame on the 20 first eigenresiduals). Therefore, those eigenresiduals form a set of relevant RN frames.

Figure 7:
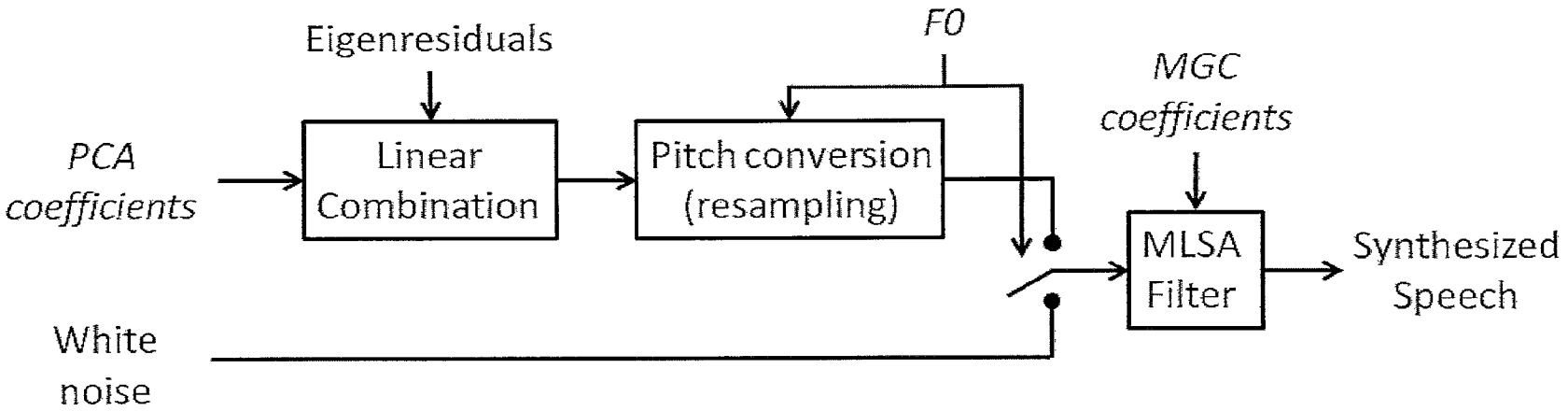
FIG. 7 is representing an excitation synthesis according to the present invention, using PCA eigenresiduals.

Once the PCA transform is calculated, the whole corpus is analysed and PCA-based parameters are extracted for coding the target speech excitation signal. Synthesis workflow in this case is represented in FIG. 7.

Preferably, a mixed excitation model can be used, in a deterministic plus stochastic excitation model (DSM). This allows to reduce the number of eigenresiduals for the coding and synthesis of the excitation of voiced segments without degrading the synthesis quality. In that case, the excitation signal is decomposed in a deterministic low frequency component $r_d(t)$, and a stochastic high frequency component $r_s(t)$. The maximum voiced frequency $F_{max}$ demarcates the boundary between both deterministic and stochastic components. Values from 2 to 6 kHz, preferably around 4 kHz can be used as $F_{max}$.

In the case of DSM, the stochastic part of the signal $r_s(t)$ is a white noise passed through a high frequency pass filter having a cut-off at $F_{max}$, for example, an auto-regressive filter can be used. Preferably, an additional time dependency can be superimposed to the frequency truncated white noise. For example, a GCI centred triangular envelope can be used.

$r_d(t)$ on the other hand, is calculated in the same way as previously described, by coding and synthesising normalised residual frames by linear combination of eigenresiduals. The obtained residual normalised frame is then denormalised to the target pitch and energy.

Figure 8:
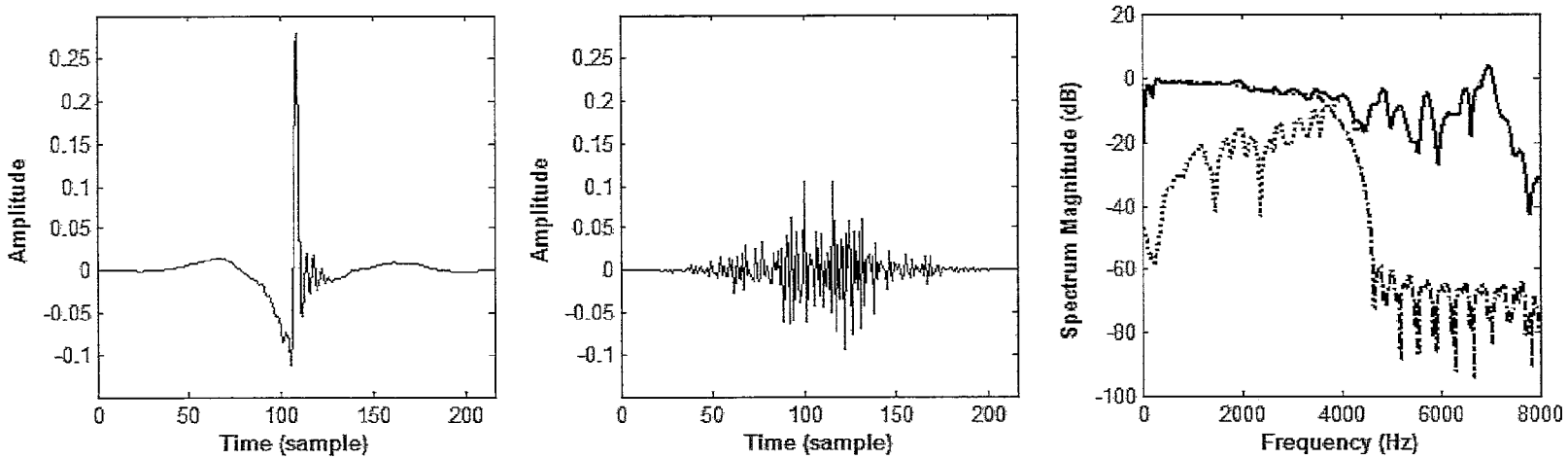
FIG. 8 is representing an example of DSM decomposition on a pitch-synchronous residual frame. Left panel: the deterministic part. Middle panel: the stochastic part. Right panel: amplitude spectra of the deterministic part (dash-dotted line), the noise part (dotted line) and the reconstructed excitation frame (solid line) composed of the superposition of both components.

The obtained deterministic and stochastic components are represented in FIG. 8.

Figure 9:
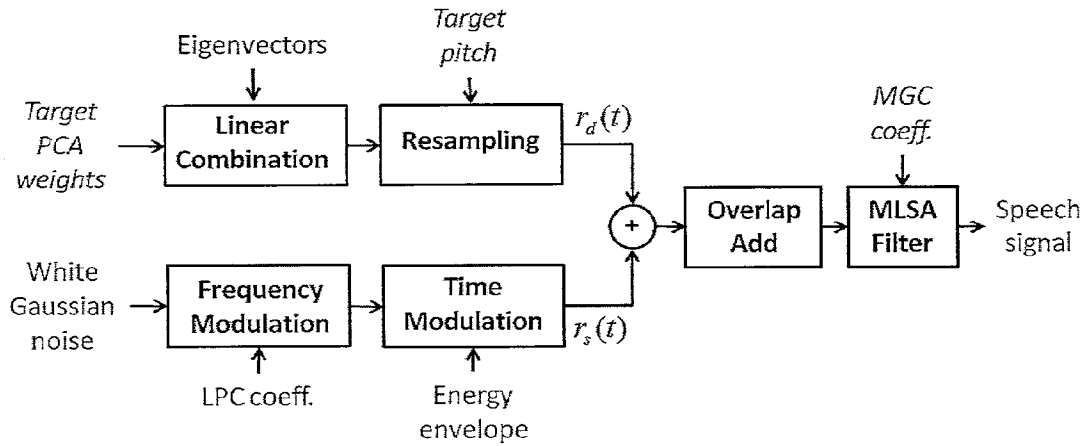
FIG. 9 is representing the general workflow of the synthesis of an excitation signal according to the present invention, using a deterministic plus a stochastic components method.

The final excitation signal is then the sum $r_d(t)+r_s(t)$. The general workflow of this excitation model is represented in FIG. 9.

The quality improvement of this DSM model is such that that the use of only one eigenresidual was sufficient to get acceptable results. In this case, excitation is only characterised by the pitch, and the stream of PCA weights may be removed. This leads to a very simple model, in which the excitation signal is essentially (below $F_{max}$) a time-wrapped waveform, requiring almost no computational load, while providing high-quality synthesis.

In any cases, the excitation on unvoiced segments is Gaussian white noise.

As another alternative, determination of the set of relevant frames is represented by a codebook of residual frames, determined by K-means algorithm. The K-means algorithm is a method to cluster n objects based on attributes into k partitions, k<n. It assumes that the object attributes form a vector space. The objective it tries to achieve is to minimise total intra-cluster variance, or, the squared error function:

$$V = \sum_{i=1}^{k} \sum_{x_j \in S_i} (x_j - \mu_i)^2$$

where there are k clusters $S_i$, i=1, 2, . . . , k, and $\mu_i$ is the centroid or mean point of all the points $x_j \epsilon S_i$.

Both K-means extracted centroids and PCA extracted eigenvectors represent relevant residual frames for representing target normalised residual frames by linear combination with a minimum number of coefficients (parameters).

The K-means algorithm being applied to the RN frames previously described, retaining typically 100 centroids, as it was found that 100 centroids were enough for keeping the compression almost inaudible. Those 100 selected centroids form a set of relevant normalised residual frames forming a codebook.

Figure 10:
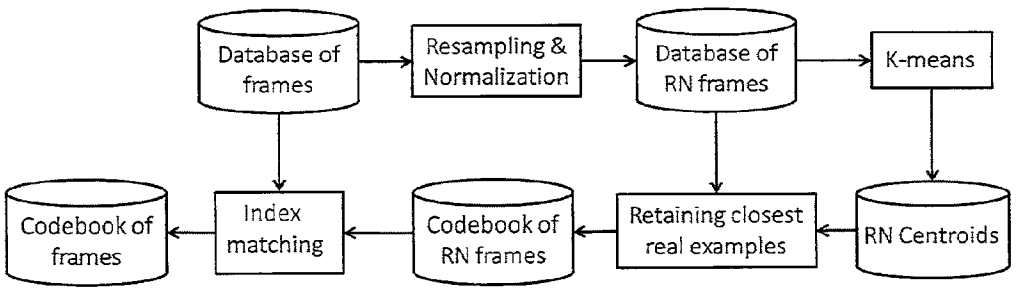
FIG. 10 is representing the method for determining the codebooks of RN and pitch-synchronous residual frames respectively

Preferably, each centroid can be replaced by the closest RN frame from the real training dataset, forming a codebook of RN frames. FIG. 10 is representing the general workflow for determining the codebooks of RN frames.

Indeed as the variability due to formants and pitch has been eliminated a great gain of compression can be expected. A real residual frame can then be assigned to each centroid. For this, the difficulties that will appear when the residual frame will have to be converted back to targeted pitch frames are to be taken into account. In order to reduce the appearance of "energy holes" during the synthesis, frames composing the compressed inventory are chosen so as to exhibit a pitch as low as possible. For each centroid, the N-closest frames (according to their RN distance) are selected, and only the longest frame is retained. Those selected closest frames will be referred hereafter as centroid residual frames.

Figure 11:
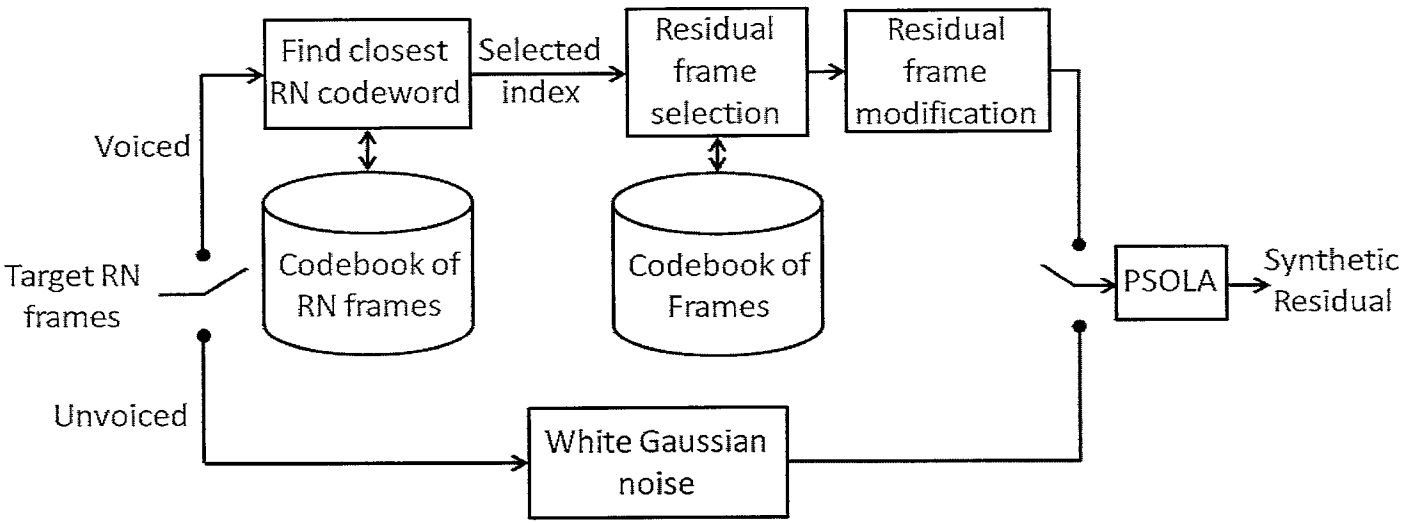
FIG. 11 is representing the coding and synthesis procedure in the case of the method using K-means method.

Coding is then obtained by determining for each target normalised residual frame the closest centroid. Said closest centroid is determined by computing the mean square error between the target normalised residual frame, and each centroid, closest centroid being that minimising the calculated mean square error. This principle is explained in FIG. 11.

The relevant normalised residual frames can then be used to improve speech synthesiser, such as those based on Hidden Markov Model (HMM), with a new stream of excitation parameters besides the traditional pitch feature.

During synthesis, synthetic residual frames are then produced by linear combination of the relevant RN (i.e. combination of eigenresiduals in case of PCA analysis, or closest centroid residual frames in the case of K-means), using the parameters determined in the coding phase.

The synthetic residual frames are then adapted to the target prosodic values (pitch and energy) and then overlap-added to obtain the target synthetic excitation signal.

The so called Mel Log Spectrum approximation (MLSA) filter, based on the generated MGC coefficients, can finally be used to produce a synthesised speech signal.

Example 1

The above mentioned K-means method has first been applied on a training dataset (speech sample). Firstly, MGC analysis was performed with $\alpha$=0.42 (Fs=16 kHz) and $\gamma$=−⅓, as these values gave preferred perceptual results. Said MGC analysis determined the synthesis filters.

The test sentences (not contained in the dataset) were then MGC analysed (parameters extraction, for both excitation and filters). GCIs were detected such that the framing is GCI-centred and two-period long during voiced regions. To make the selection, these frames were resampled and normalised so as to get the RN frames. These latter frames were input into the excitation signal reconstruction workflow shown in FIG. 11.

Once selected from the set of relevant normalised residual frames, each centroid normalised residual frame was modified in pitch and energy so as to replace the original one.

Unvoiced segments were replaced by a white noise segment of same energy. The resulting excitation signal was then filtered by the original MGC coefficients previously extracted.

The experiment was carried out using a codebook of 100 clusters, and 100 corresponding residual frames.

Example 2

In a second example, a statistical parametric speech synthesiser has been determined. The feature vectors consisted of the 24th-order MGC parameters, log-F0, and the PCA coefficients whose order has been determined as explained hereabove, concatenated together with their first and second derivatives. MCG analysis was performed with $\alpha$=0.42 (Fs=16 kHz) and $\gamma$=−⅓. A Multi-Space Distribution (MSD) was used to handle voiced/unvoiced boundaries (log-F0 and PCA being determined only on voiced frames), which leads to a total of 7 streams. 5-state left-to-right context-dependent phoneme HMMs were used, using diagonal-covariance single-Gaussian distributions. A state duration model was also determined from HMM state occupancy statistics. During the speech synthesis process, the most likely state sequence is first determined according to the duration model. The most likely feature vector sequence associated to that state sequence is then generated. Finally, these feature vectors are fed into a vocoder to produce the speech signal.

The vocoder workflow is depicted in FIG. 7. The generated F0 value commands the voiced/unvoiced decision. During unvoiced frames, white noise is used. On the opposite, the voiced frames are constructed according to the synthesised PCA coefficients. A first version is obtained by linear combination with the eigenresiduals extracted as detailed in the description. Since this version is size-normalised, a conversion towards the target pitch is required. As already stated, this can be achieved by resampling. The choice made during the normalisation of a sufficiently low pitch is now clearly understood as a constraint for avoiding the emergence of energy holes at high frequencies. Frames are then overlap-added so as to obtain the excitation signal. The so-called Mel Log Spectrum Approximation (MLSA) filter, based on the generated MGC coefficients, is finally used to get the synthesised speech signal.

Example 3

In a third example, the same method as in the second example was used, except that only the first eigenresidual was used, and that a high frequency noise was added, as described in the DSM model hereabove. $F_{max}$ was fixed at 4 kHz, and $r_s(t)$ was a white Gaussian noise n(t) convolved with an autoregressive model h(τ,t) (high pass filter) and whose time structure was controlled by a parametric envelope e(t):

$$r_s(t)=e(t)\cdot(h(\tau,t)*n(t))$$

Wherein e(t) is a pitch-dependent triangular function. Some further work has shown that e(t) was not a key feature of the noise structure, and can be a flat function such as e(t)=1 without degrading the final result in a perceptible way.

For each example, three voices were evaluated: Bruno (French male, not from the CMU ARCTIC database), AWB (Scottish male) and SLT (US female) from the CMU ARCTIC database. The training set had duration of about 50 min. for AWB and SLT, and 2 h for Bruno and was composed of phonetically balanced utterances sampled at 16 kHz.

Figure 12:
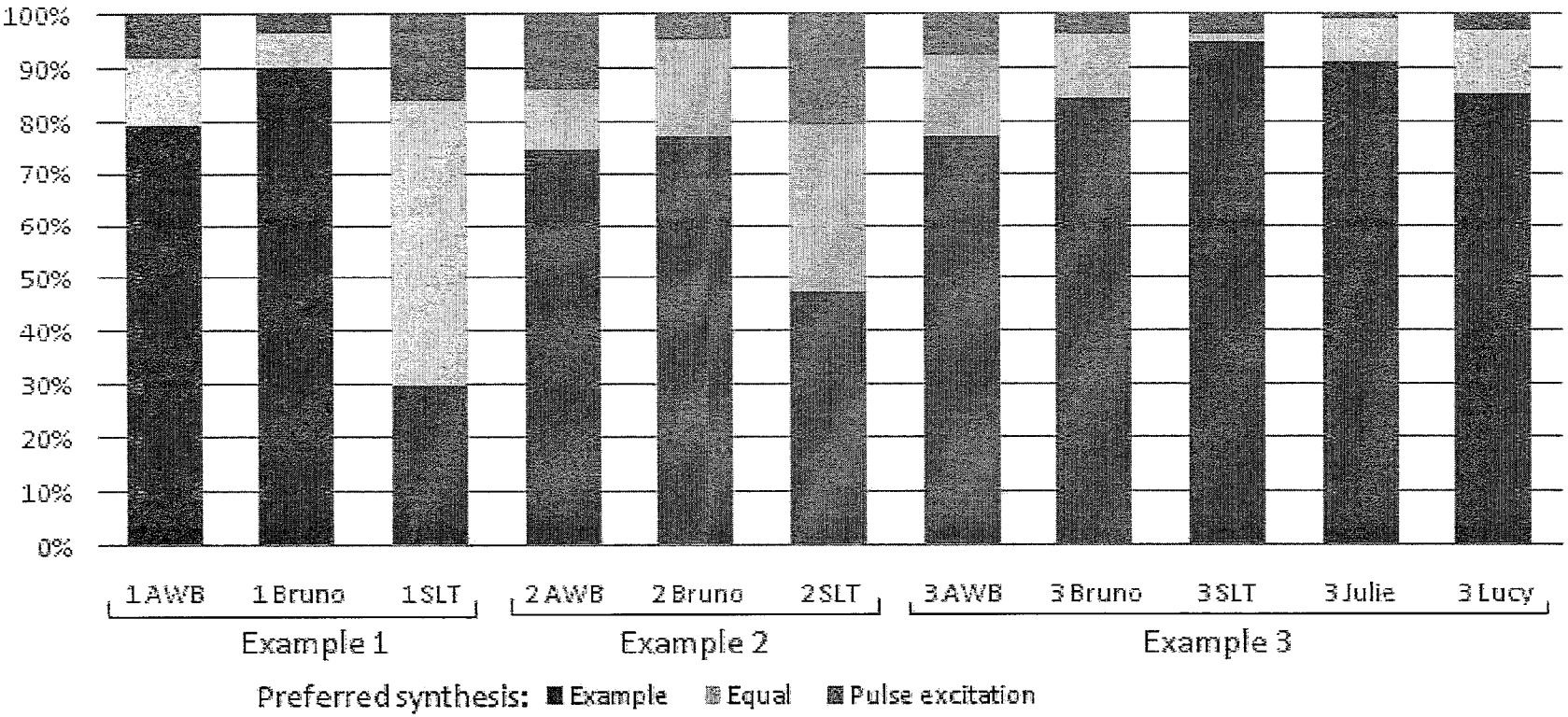
FIG. 12 is representing the results of preference test with respect to the traditional pulse excitation experiment carried out with the coding and synthesis method of the present invention.

The subjective test was submitted to 20 non-professional listeners. It consisted of 4 synthesised sentences of about 7 seconds per speaker. For each sentence, two versions were presented, using either the traditional excitation or the excitation according to the present invention, and the subjects were asked to vote for the one they preferred. The traditional excitation method was using a pulse sequence during voiced excitation (i.e. the basic technique used in HMM-based synthesis). Even for this traditional technique, GCI-synchronous pulses were used so as to capture micro-prosody, the resulting vocoded speech therefore provided a high-quality baseline. The results are shown in FIG. 12. As can be seen, an improvement can be seen in each of the three experiments, numbered 1 to 3 in FIG. 12.

The invention claimed is:

1. A method for coding excitation signal of a target speech on a computing device, comprising:

extracting from a set of training normalised residual frames a set of relevant normalised residual frames with the computing device, wherein the set of training normalised residual frames is extracted from training speech, synchronised on Glottal Closure Instants (CGI), and normalised in pitch and energy;

determining a target excitation signal from the target speech on the computing device;

dividing the target excitation signal into GCI synchronised target frames on the computing device;

determining a local pitch period and energy of the GCI synchronised target frames on the computing device;

normalising the GCI synchronised target frames in relation to the determined local pitch period and energy on the computing device to obtain target normalised residual frames; and determining coefficients of linear combination of the extracted set of relevant normalised residual frames on the computing device to build synthetic normalised residual frames close to each target normalised residual frames, wherein coding parameters for each of the target normalised residual frames comprise the determined coefficients.

2. The method of claim 1, wherein determining a target excitation signal from the target speech comprises applying an inverse synthesis filter to the target speech on the computing device.

3. The method of claim 2 wherein the inverse synthesis filter applied to the target speech is determined on the computing device by performing a spectral analysis.

4. The method of claim 3 wherein, the set of relevant normalised residual frames is determined on the computing device by performing one of a K-means algorithm and a principal component analysis.

5. The method of claim 2 wherein, the set of relevant normalised residual frames is determined on the computing device by performing one of a K-means algorithm and a principal component analysis.

6. The method of claim 1 wherein the set of relevant normalised residual frames is determined on the computing device by performing one of a K-means algorithm and a principal component analysis.

7. The method of claim 6 wherein the set of relevant normalised residual frames is determined on the computing device by performing a K-means algorithm to determine clusters, and wherein the set of relevant normalised residual frames are centroids of the determined clusters.

8. The method of claim 7, wherein a coefficient associated with a cluster centroid closest to a target normalised residual frame is equal to one, and wherein others coefficients are null.

9. The method of claim 6, wherein the set of relevant normalised residual frames is a set of first eigenresiduals determined on the computing device by performing a principal component analysis.

10. The method of claim 1, further comprising:

generating synthetic normalised residual frames on the computing device by linear combination of the set of relevant normalised residual frames using the coding parameters;

denormalising the synthetic normalised residual frames in pitch and energy on the computing device to obtain synthetic residual frames having the determined local pitch period and energy; and recombining the synthetic residual frames on the computing device by performing a pitch-synchronous overlap add method to obtain a synthetic excitation signal.

11. The method of claim 10 wherein:

the set of relevant normalised residual frames is a set of first eigenresiduals determined by a principal component analysis; and the method further comprises adding a high frequency noise to the synthetic residual frames with the computing device.

12. The method of claim 11, wherein the high frequency noise has a low frequency cut-off between 2 kHz and 6 kHz.

13. The method of claim 11, wherein the high frequency noise has a low frequency cut-off between 3 kHz and 5 kHz.

14. A set of instructions recorded on a non-transitory computer readable medium and configured to cause a computing device to perform operations comprising:

extracting from a set of training normalised residual frames a set of relevant normalised residual frames, wherein the set of training normalised residual frames is extracted from training speech, synchronised on Glottal Closure Instants (CGI), and normalised in pitch and energy;

determining a target excitation signal from the target speech;

dividing the target excitation signal into GCI synchronised target frames;

determining a local pitch period and energy of the GCI synchronised target frames;

normalising the GCI synchronised target frames in relation to the determined local pitch period and energy to obtain target normalised residual frames; and determining coefficients of linear combination of the extracted set of relevant normalised residual frames to build synthetic normalised residual frames close to each target normalised residual frames, wherein coding parameters for each of the target normalised residual frames comprise the determined coefficients.

15. The set of instructions recorded on a non-transitory computer readable medium of claim 14, wherein the set of instructions are configured to cause the computing device to perform operations further comprising:

generating synthetic normalised residual frames by linear combination of the set of relevant normalised residual frames using the coding parameters;

denormalising the synthetic normalised residual frames in pitch and energy to obtain synthetic residual frames having the determined local pitch period and energy; and recombining the synthetic residual frames by performing a pitch-synchronous overlap add method to obtain a synthetic excitation signal.

* * * * *